US008457531B2

(12) United States Patent
Sugiyama

(10) Patent No.: US 8,457,531 B2
(45) Date of Patent: Jun. 4, 2013

(54) IMAGE FORMING APPARATUS

(75) Inventor: Yuki Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/179,310

(22) Filed: Jul. 8, 2011

(65) Prior Publication Data

US 2012/0014717 A1 Jan. 19, 2012

(30) Foreign Application Priority Data

Jul. 14, 2010 (JP) ..... 2010-159883

(51) Int. Cl.
*G03G 15/01* (2006.01)

(52) U.S. Cl.
USPC ..... 399/228; 399/53

(58) Field of Classification Search
USPC ..... 399/228
See application file for complete search history.

(56) References Cited

U.S. PATENT DOCUMENTS

2010/0124427 A1 5/2010 Sugiyama

FOREIGN PATENT DOCUMENTS

| | | | |
|---|---|---|---|
| JP | 2001-318506 | A | 11/2001 |
| JP | 2006-171360 | A | 6/2006 |
| JP | 2006-292868 | A | 10/2006 |
| JP | 2010-140016 | A | 6/2010 |

*Primary Examiner* — Clayton E LaBalle
*Assistant Examiner* — Jas Sanghera
(74) *Attorney, Agent, or Firm* — Canon USA Inc IP Division

(57) ABSTRACT

An image forming apparatus includes a plurality of image carriers, a plurality of developing units configured to contact each of the plurality of image carriers to develop a latent image formed on each of the plurality of image carriers, a contact and separation unit configured to perform contact and separation of the plurality of image carriers and the plurality of developing units, a drive unit that drives the contact and separation unit, and a control unit that controls a drive speed of the drive unit so that the plurality of developing units are separated from the plurality of image carriers after the development performed by the plurality of developing units is completed, and the control unit controls the drive speed so that a last developing unit is separated after completion timing of development performed by the last developing unit and before separation timing of the last developing unit.

3 Claims, 11 Drawing Sheets

IMAGE FORMING APPARATUS

BACKGROUND OF THE INVENTION

1. Field of the Invention

The present invention relates to an image forming apparatus including an image carrier and a developing unit configured to develop a latent image formed on the image carrier.

2. Description of the Related Art

Among apparatuses that form images called image forming apparatuses, there is a type of apparatus that includes a plurality of photosensitive drums for image forming. An image formed on each of the photosensitive drums is sequentially transferred onto an intermediate transfer belt that faces the plurality of photosensitive drums or onto a recording medium carried by a transfer belt which is conveyed. A known method of development methods for such an image forming apparatus is called a contact development method. The contact development method develops the image while the development roller as a developer carrying member rotates in contact with the photosensitive drum.

According to the contact development method, since the development roller and the photosensitive drum rotate in a contact state, abrasion of both the photosensitive drum and the development roller occurs due to the friction between the development roller and the photosensitive drum. Thus, if the photosensitive drum and the development roller continue to contact each other unnecessarily, the operating life of the photosensitive drum and the development roller will be shortened. Thus, Japanese Patent Application Laid-Open No. 2006-292868 discusses a configuration that allows contact and separation of the development roller and the photosensitive drum.

However, according to the control of the conventional configuration that allows the contact and separation, although the abrasion of the photosensitive drum and the development roller can be reduced compared to a case where the development roller continuously contacts on the photosensitive drum, since the contact time is determined based on the size of the recording medium on which the image is formed, the development roller may unnecessarily contact the photosensitive drum depending on the size of the recording medium even if the contact and separation is performed.

More specifically, if the length of time necessary in image forming is shorter than the length of time the development roller contacts the photosensitive drum, which is determined by the size of recording medium, the difference time between them is unnecessary contact time. This causes abrasion of the photosensitive drum and the development roller.

SUMMARY OF THE INVENTION

The present invention is directed to a method for controlling contact time of a photosensitive drum and a development roller according to a size of an image to be formed and reducing abrasion of the photosensitive drum and the development roller.

According to an aspect of the present invention, an image forming apparatus includes a plurality of image carriers, a plurality of developing units configured to contact each of the plurality of image carriers to develop a latent image formed on each of the plurality of image carriers, a contact and separation unit configured to perform contact and separation of the plurality of image carriers and the plurality of developing units, a drive unit configured to drive the contact and separation unit, and a control unit configured to control a drive speed of the drive unit so that the plurality of developing units are separated from the plurality of image carriers after the development performed by the plurality of developing units is completed. The control unit performs control such that, out of the plurality of image carriers and the plurality of developing units, upon completion of the development performed by a last developing unit whose development of the latent image formed on the image carrier is performed last, by driving the drive unit, which is driving at a predetermined speed, at a drive speed faster than the predetermined drive speed so that the last developing unit is separated after the completion timing of the development performed by the last developing unit and before separation of the last developing unit when the drive speed of the drive unit is unchanged.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The exemplary embodiments described below shall not to be construed as limiting the scope of the present invention. Further, all the combinations of features described in the exemplary embodiments are not always necessary in solving the problems of the present invention.

Figure 1:
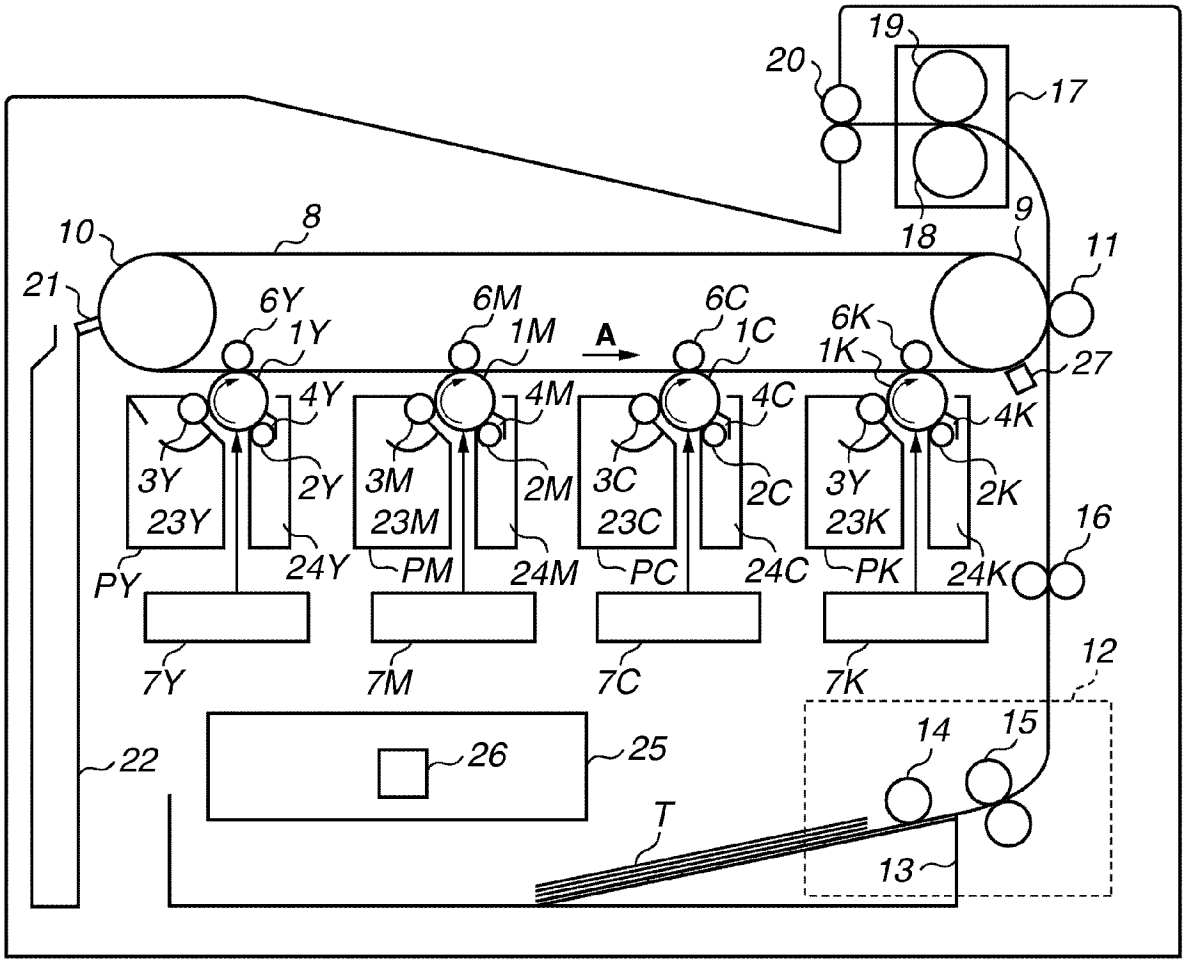
FIG. 1 is a schematic diagram of an image forming apparatus.

FIG. 1 illustrates a color image forming apparatus using an intermediate transfer belt which is an intermediate transfer member according to a first exemplary embodiment of the present invention. Process cartridges PY, PM, PC, and PK (P) in FIG. 1 are removable from the image forming apparatus. The cartridges PY, PM, PC, and PK have a same structure and include toner containers 23Y, 23M, 23C, and 23K, respectively. Further, the color image forming apparatus includes photosensitive drums 1Y, 1M, 1C, and 1K which are image carriers, charge rollers 2Y, 2M, 2C, and 2K, and development rollers 3Y, 3M, 3C, and 3K. Furthermore, the color image forming apparatus includes drum cleaning blades 4Y, 4M, 4C, and 4K and waste toner containers 24Y, 24M, 24C, and 24K. The toner containers 23Y, 23M, 23C, and 23K contain yellow (Y), magenta (M), cyan (C), and black (K) toner, respectively.

The photosensitive drums 1Y, 1M, 1C, and 1K are negatively charged at predetermined potential by the charge rollers 2Y, 2M, 2C, and 2K, respectively. Then, an electrostatic latent image is formed by each of laser units 7Y, 7M, 7C, and 7K. Each of the electrostatic latent images goes under reversal development by each of the development rollers 3Y, 3M, 3C, and 3K. Thus, toner of negative polarity is attached to each of the electrostatic latent images and a toner image of each of Y, M, C, and K colors is formed on each of the photosensitive drums.

An intermediate transfer belt unit includes an intermediate transfer belt 8, a drive roller 9, and a driven roller 10. Further, primary transfer rollers 6Y, 6M, 6C, and 6K are provided on the surface of the intermediate transfer belt 8 on the inward side. The primary transfer rollers 6Y, 6M, 6C, and 6K face the photosensitive drums 1Y, 1M, 1C, and 1K, respectively. Transfer bias is applied by a bias application unit (not shown). Furthermore, a color misregistration detection sensor 27 which is an optical sensor is provided. The color misregistration detection sensor 27 is provided in the vicinity of the drive roller 9 and detects a toner pattern for color misregistration detection formed on the intermediate transfer belt 8.

The color misregistration detection sensor 27 includes an infrared light emitting element such as a light-emitting diode (LED), a light receiving element such as a photodiode, an integrated circuit (IC) used for processing data of the received light, and a holder that holds these elements. A detection principle of a toner pattern is that infrared light, which is emitted from a light emitting element, is reflected from the toner pattern, and the intensity of the reflected light is detected by a light receiving element. In this manner, presence/absence of a toner pattern of each color is detected. As for the detection of the reflected light, either specular reflection or diffused reflection can be used.

Each of the toner images formed on the photosensitive drums 1Y, 1M, 1C, and 1K is sequentially transferred (primary transfer) onto the intermediate transfer belt 8 starting from the toner image on the photosensitive drum 1Y by rotating each of the photosensitive drums in the direction of the arrow, rotating the intermediate transfer belt 8 in the direction of the arrow A, and applying bias of positive polarity to the primary transfer rollers 6Y, 6M, 6C, and 6K. Then, an image formed by the toner images of Y, M, C, and K colors is conveyed to a secondary transfer roller 11.

A feeding and conveyance device 12 includes a feeding roller 14 and a conveyance roller pair 15. The feeding roller 14 is used for feeding a recording medium T from a sheet cassette 13 that contains the recording medium T. The conveyance roller pair 15 is used for conveying the recording medium T which has been fed. The recording medium T conveyed from the feeding and conveyance device 12 is conveyed to the secondary transfer roller 11 by a registration roller pair 16. When the bias of positive polarity is applied to the secondary transfer roller 11, the image formed on the intermediate transfer belt 8 is transferred (secondary transfer) onto the recording medium T which has been conveyed. The recording medium T with the secondary-transferred image is conveyed to a fixing apparatus 17. Then, the fixing apparatus 17 fixes the image onto the recording medium T by applying heat and pressure with a fixing film 18 and a pressure roller 19. Subsequently, the recording medium T with the fixed image is discharged by a discharge roller pair 20.

On the other hand, the toner that remains on the surface of each of the photosensitive drums 1Y, 1M, 1C, and 1K after the primary transfer is removed by the cleaning blades 4Y, 4M, 4C, and 4K. Further, the toner that remains on the intermediate transfer belt 8 after the secondary transfer onto the recording medium T is removed by a transfer belt cleaning blade 21 and collected in a waste toner recovery container 22.

Further, the image forming apparatus includes a control board 25. An electric circuit used for controlling the image forming apparatus is mounted on the control board 25. A central processing unit (CPU) 26 is mounted on the control board 25. The CPU 26 controls the overall operation of the image forming apparatus. For example, the CPU 26 controls a drive source of a motor (not shown) that realizes the conveyance of the recording medium T and a motor (not shown) that realizes the drive of the process cartridges PY, PM, PC, and PK. Further the CPU 26 controls image forming operations and failure detecting operations. A motor drive IC that controls the drive of a contact and separation motor 31 is also included in the control board 25.

The CPU 26 changes the excitation of the contact and separation motor 31 by transmitting a pulse signal to the motor drive IC. According to the present embodiment, a two-phase excitation method is used. The motor drive IC that received the pulse signal controls the direction of the electric current that passes through a coil of the contact and separation motor 31 according to the pulse signal. When the direction of the electric current is changed, a field pole of the contact and separation motor 31 is reversed and, accordingly, a rotor magnet rotates. The rotation speed of the contact and separation motor 31 is dependent on a frequency of the pulse signal transmitted from the CPU 26 (hereinafter defined as a drive frequency). The higher the drive frequency, the shorter the reverse cycle of the field pole of the contact and separation motor 31. Thus, the rotation speed of the contact and separation motor 31 will be increased.

Figure 2:
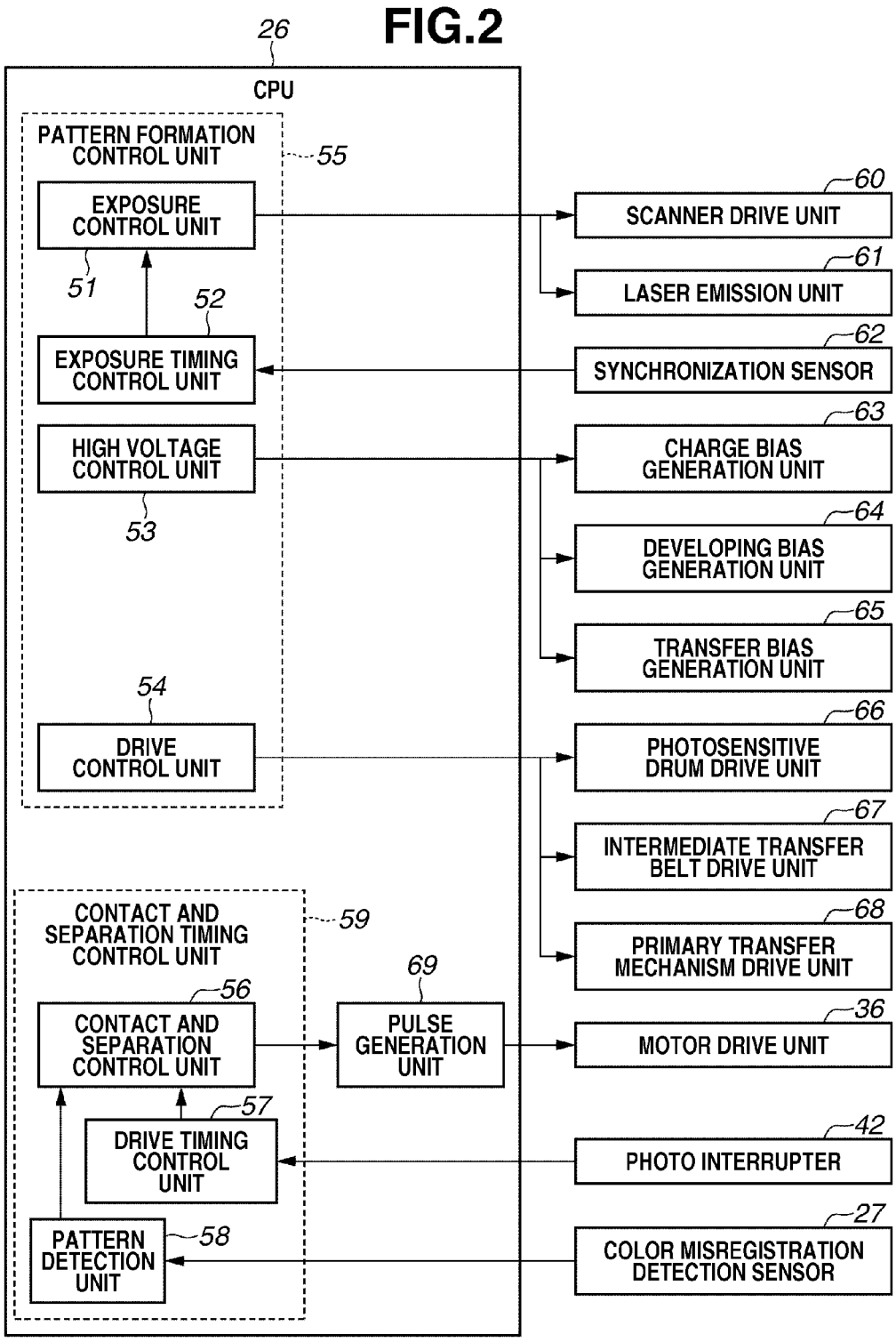
FIG. 2 illustrates a configuration of the image forming apparatus.

FIG. 2 is a block diagram illustrating a configuration of the image forming apparatus. The CPU 26 includes a pattern formation control unit 55 used for forming a toner pattern and a contact and separation timing control unit 59 used for controlling the contact and separation of the development roller 3 based on a detection result of the toner pattern.

An exposure control unit 51, which is included in the pattern formation control unit 55, controls a scanner drive unit 60 and a laser emission unit 61. The scanner drive unit 60 drives a polygonal mirror (not shown) provided in the laser unit 7. The laser emission unit 61 emits a laser beam. Further, the laser unit 7 includes a synchronization sensor 62 which detects a laser beam reflected from the polygonal mirror. A detection signal generated by the synchronization sensor 62 is transmitted to an exposure timing control unit 52 in the pattern formation control unit 55.

The exposure timing control unit 52 generates timing based on the detection signal which has been input. The exposure control unit 51 drives the laser emission unit 61 based on the generated timing. According to a laser beam emitted from the laser emission unit 61, an electrostatic latent image is formed on the photosensitive drum 1. Then, the formed electrostatic latent image is developed by the development roller 3, so that a toner pattern is formed. By adjusting the timing of laser emission according to the timing obtained from the synchronization sensor 62, the toner pattern is formed in the detection range of the color misregistration detection sensor 27 described below with reference to FIG. 8.

A high voltage control unit 53 controls a charge bias generation unit 63 that generates a voltage necessary in forming an image, a developing bias generation unit 64, and a transfer bias generation unit 65. As a drive control unit for image forming, a drive control unit 54 controls a photosensitive drum drive unit 66, an intermediate transfer belt drive unit 67, and a primary transfer mechanism drive unit 68.

An contact separation control unit 56, which is included in the contact and separation timing control unit 59, controls a pulse generation unit 69 to drive the contact and separation motor 31. The pulse signal generated by the pulse generation unit 69 is transmitted to a motor drive unit (motor drive IC) 36. Further, a signal generated by a photo interrupter 42, which is a position detection sensor, is transmitted to a drive timing control unit 57 and used for controlling the contact and separation. A pattern detection unit 58 receives a confirmation result of a toner pattern transmitted from the color misregistration detection sensor 27, and reflects the detection result to the contact and separation control during the image forming.

Next, the mechanism that switches between the contact and the separation of the development roller 3 and the photosensitive drum 1 will be described with reference to FIGS. 3A to 3C. The contact and separation motor 31, which is a drive source to switch between the contact and the separation of the development roller 3 and the photosensitive drum 1, is a stepping motor and is connected to a drive change shaft 32 via a pinion gear. According to the present exemplary embodiment, although a stepping motor is given as an example of the contact and separation motor 31, the type of the contact and separation motor is not limited to a stepping motor and motors similarly used as a drive source such as a DC brush motor or a DC brushless motor can also be used.

Worm gears 33Y, 33M, 33C, and 33K used for driving cam gears 34Y, 34M, 34C, and 34K of the four colors are provided on the drive change shaft 32. When the drive change shaft 32 rotates, the phase of each of cams 35Y, 35M, 35C, and 35K of the corresponding cam gears 34Y, 34M, 34C, and 34K as contact and separation units is changed. Thus, by applying a pressing force to a side of the process cartridge P or releasing the pressing force from the process cartridge P, the contact and separation state of the photosensitive drum 1 and the development roller 3 can be changed by only one contact and separation motor 31.

Figure 3A:
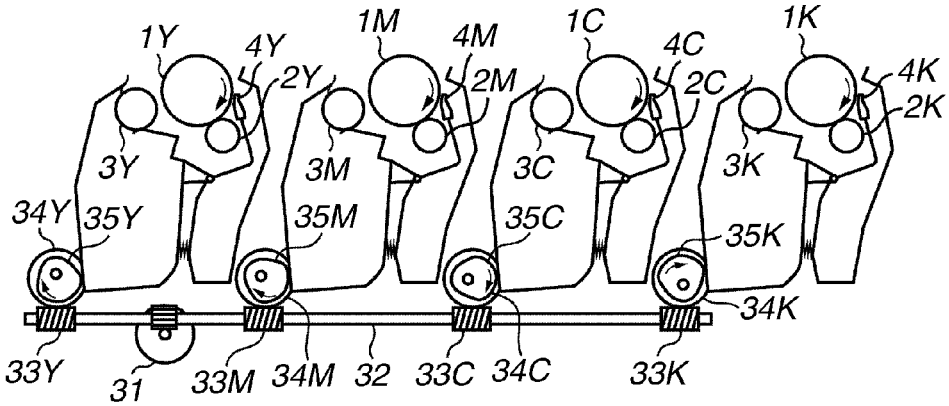
FIGS. 3A to 3C illustrate a mechanism used for changing contact and separation of a development roller and a photosensitive drum.

FIG. 3A illustrates a stand-by state (full separation state) where the cams 35Y, 35M, 35C, and 35K press the sides of the process cartridges PY, PM, PC, and PK with the maximum radius of the cams, so that all the development rollers 3Y, 3M, 3C, and 3K are separated from all the photosensitive drums 1Y, 1M, 1C, and 1K.

Figure 3B:
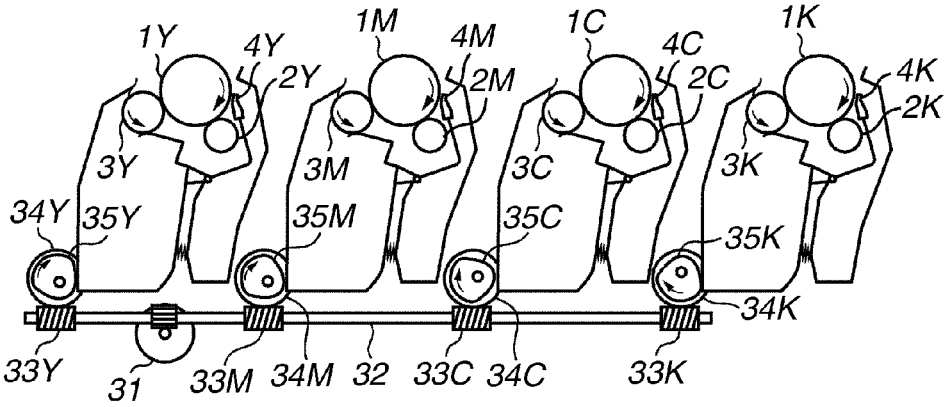

FIG. 3B illustrates an contact state (full-color contact state) where the pressure by the cams 35Y, 35M, 35C, and 35K onto the sides of the process cartridges PY, PM, PC, and PK is released, so that all the development rollers 3Y, 3M, 3C, and 3K contact all the photosensitive drums 1Y, 1M, 1C, and 1K.

Figure 3C:
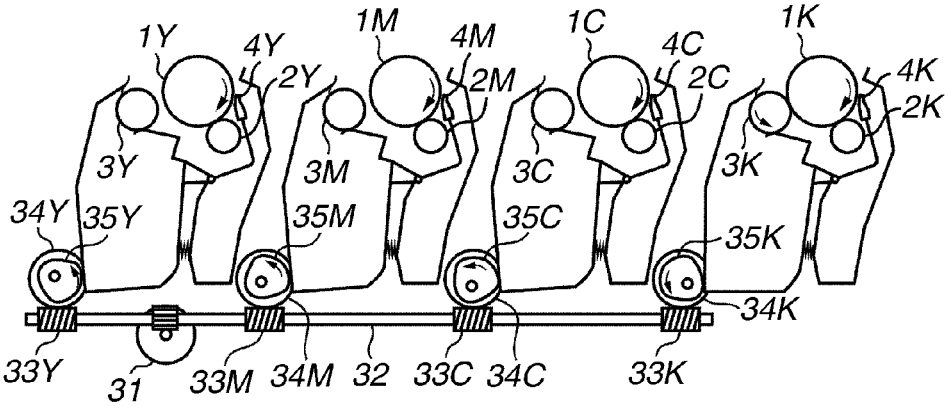

FIG. 3C illustrates a monocolor contact state. Although the cams 35Y, 35M, and 35C of the yellow (Y), magenta (M), and cyan (C) colors press the sides of the corresponding process cartridges PY, PM, and PC with the maximum radius, the pressing force of the cam 35K of the black (K) color is released from the side of the process cartridge PK. Thus, only the development roller 3K contacts the photosensitive drum 1K.

Next, a state change from the stand-by state illustrated in FIG. 3A to the full-color contact state illustrated in FIG. 3B and a state change from the stand-by state illustrated in FIG. 3A to the monocolor contact state illustrated in FIG. 3C will be described. If the contact and separation motor 31 performs positive rotation when the mechanism is in the stand-by state illustrated in FIG. 3A, each of the cams 35Y, 35M, 35C, and 35K rotates in the clockwise direction. With reference to the cam 35Y, each phase of the cams 35M, 35C, and 35K has a phase offset in the counterclockwise direction in the order of the cam 35M, the cam 35C, and the cam 35K.

According to this phase offset, when each of the cams 35Y, 35M, 35C, and 35K rotates in the clockwise direction, the cam 35Y releases the pressing force from the side of the process cartridge PY. Next, depending on the phase offset, the cams 35M, 35C, and 35K release the pressing force from the side of the corresponding process cartridge in the order of the cam 35M, the cam 35C, and the cam 35K. If the contact and separation motor 31 performs positive rotation while the mechanism is in the stand-by state in FIG. 3A, each of the development rollers 3Y, 3M, 3C, and 3K contacts each of the photosensitive drums 1Y, 1M, 1C, and 1K in the order of Y, M, C, and K. Then the state of the mechanism is changed to the full-color contact state illustrated in FIG. 3B. If the state changes from the full-color contact state to the stand-by state, positive rotation of the contact and separation motor 31 is performed. Then, each of the development rollers 3Y, 3M, 3C, and 3K is separated from each of the photosensitive drums 1Y, 1M, 1C, and 1K in the order of Y, M, C, and K.

If the contact and separation motor 31 performs negative rotation when the mechanism is in the stand-by state illustrated in FIG. 3A, each of the cams 35Y, 35M, 35C, and 35K rotates in the counterclockwise direction. Specifically, if the contact and separation motor 31 performs negative rotation, the cam 35K releases the application of a force from the side of the process cartridge PK. The drive of the contact and separation motor 31 stops in this state, then the state of the mechanism is changed to the monocolor contact state illustrated in FIG. 3C.

If the monocolor contact state is to be changed to the stand-by state, the contact and separation motor 31 is controlled so that it performs positive rotation. Then, once again a force is applied to the side of the process cartridge PK by the cam 35K, and the state of the mechanism is changed to the stand-by state. Thus, by controlling the direction of the drive and the amount of rotation of the contact and separation motor 31, the contact and separation states of the development rollers 3Y, 3M, 3C, and 3K and the photosensitive drums 1Y, 1M, 1C, and 1K can be controlled in the three states illustrated in FIG. 3A to FIG. 3C.

Figure 4:
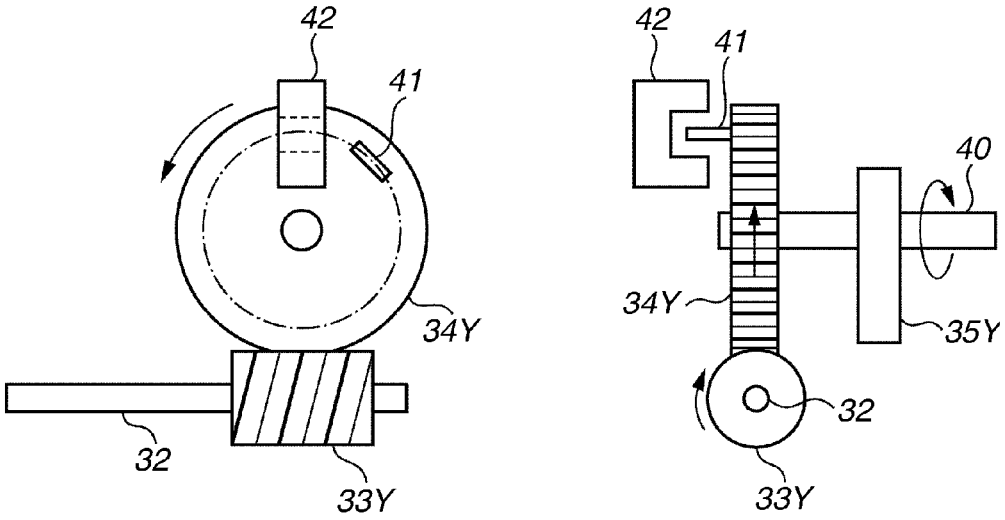
FIG. 4 illustrates a configuration of a cam gear.

The above-described control is realized since a rib 41 is formed on a portion of the cam gear 34Y (yellow) as illustrated in FIG. 4. When the cam gear 34Y rotates, the rib 41 also rotates and shields light in the photo interrupter 42. Accordingly, the phase of the cam 35Y that rotates with the cam gear 34Y can be detected by the signal output from the photo interrupter 42.

The phase of the cam 35Y (stand-by state, full-color contact state, and monocolor contact state) is controlled by setting the position where the light in the photo interrupter 42 is shielded as the reference position and managing the number of drive steps of the contact and separation motor 31 from that position. Both the cam gear 34Y and the cam 35Y are provided on a same shaft (shaft 40).

Figure 5A:
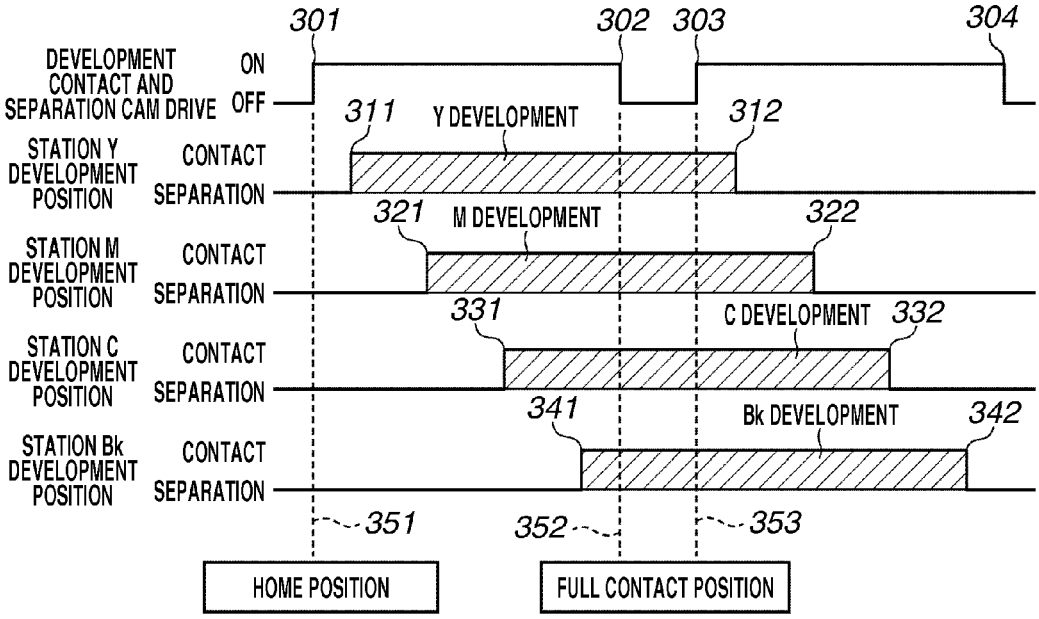
FIGS. 5A and 5B are timing charts illustrating a contact state and a separation state of each image forming station.
Figure 5B:
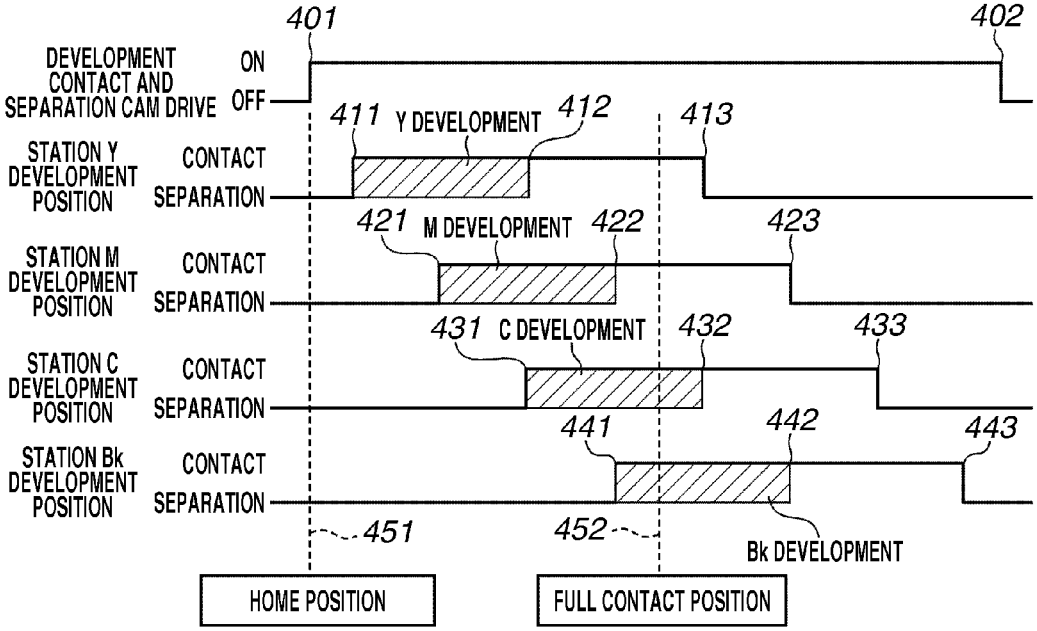

FIGS. 5A and 5B are timing charts illustrating the contact and the separation states of each of the image forming stations. FIG. 5A illustrates a case where the image forming takes longer time than the shortest contact time at the image forming station. FIG. 5B illustrates a case where the image forming takes shorter time than the shortest contact time at the image forming station.

First, the operation will be described with reference to FIG. 5A. At timing 301, the CPU 26 starts the drive of the cam 35 so that the state of the photosensitive drums 1Y, 1M, 1C, and 1K and the development rollers 3Y, 3M, 3C, and 3K is changed to the contact state. At timing 311, the development roller 3Y of a first station contacts the photosensitive drum 1Y, and the image forming is started. Similarly, at timing 321, 331, and 341, the development rollers 3M, 3C, and 3K of a second station, a third station, and a fourth station contact the photosensitive drums 1M, 1C, and 1K, respectively, and the image forming is started.

At timing 302, since all the stations are in the contact state, the CPU 26 stops the drive of the cam 35. The CPU 26 calculates a difference between the time from all the stations are set in the contact state (full contact position) to the time the separation of the first station is started by the drive of the cam 35, and the time from all the stations are set in the full contact position to the time the development of the first station is finished. In other words, the difference between time interval between timing 303 and 312 and that of timing 352 and 312 is calculated. After elapse of the calculated time interval, the drive of the cam 35 is resumed. After the CPU 26 resumes the drive of the cam 35 at timing 303, the first, the second, the third, and the fourth stations are separated at timing 312, 322, 332, and 342, respectively.

Next, the operation will be described with reference to FIG. 5B. Since the basic operations for contact and the separation are similar to those described with reference to FIG. 5A, their descriptions are not repeated. The difference with the operations in FIG. 5A is the size of the image that is formed. Regarding the case illustrated in FIG. 5B, since the time necessary in forming the image is shorter than the shortest contact time of the image forming station, the image forming at the first station is finished in the period of time between timing 411 and 412.

However, since it takes period of time from timing 411 to 413 for contact and separation of the photosensitive drum 1Y and the development roller 3Y, the photosensitive drum 1Y contacts the development roller 3Y from timing 412 to 413 although the image forming is not actually performed. This contact is unnecessary and brings about abrasion of the photosensitive drum 1Y and the development roller 3Y. In this exemplary embodiment a method for reducing the unnecessary contact time will be described below.

Figure 6:
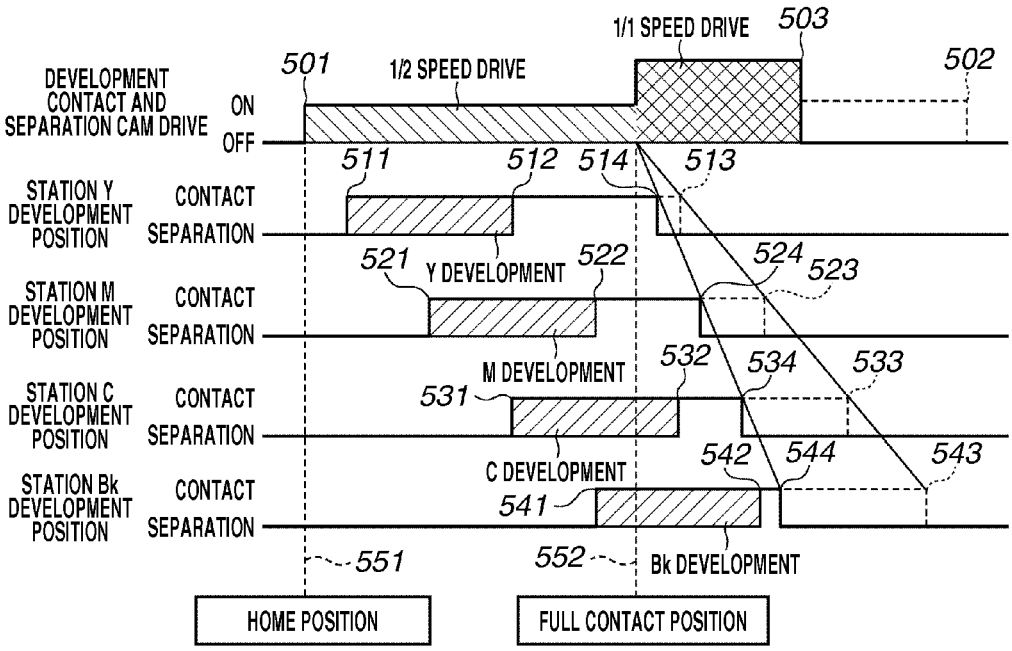
FIG. 6 is a timing chart illustrating the contact and the separation states of each image forming station according to a first exemplary embodiment of the present invention.

FIG. 6 is a timing chart illustrating the contact and the separation states of each of the image forming stations according to the present embodiment. At timing 501, the CPU 26 drives the cam 35 at ½ speed. At timing 511, the development roller 3Y of the first station contacts the photosensitive drum 1Y and the image forming is started. Further, at timing 521, 531, and 541, the development rollers 3M, 3C, and 3K of the second, the third, and the fourth stations contact the photosensitive drums 1M, 1C, and 1K, respectively, and the image forming is started.

At timing 552, when all the image forming stations are at the full contact position, the CPU 26 compares time A when the development is finished at the fourth station, which is the last station that performs the development out of the four stations, and time B which is the separation timing of the fourth station when the drive speed of the cam 35 is increased to 1/1 speed.

If time B is shorter than time A, since the development roller 3K will be separated from the photosensitive drum 1K of the fourth station before the image forming by the fourth station is finished, the CPU 26 does not increase the drive speed of the cam 35. On the other hand, if time B is longer than time A, since the development roller 3K will not be separated from the photosensitive drum 1K of the fourth station before the image forming by the fourth station is finished even if the drive speed of the cam 35 is increased, the CPU 26 increases the drive speed of the cam 35 and reduces the contact time at each station.

By increasing the drive speed of the cam 35 from ½ speed to 1/1 speed, the photosensitive drums 1Y, 1M, 1C, and 1K and the development rollers 3Y, 3M, 3C, and 3K are separated at timing 514, 524, 534, and 544 at the first, the second, the third, and the fourth stations, respectively. If the drive speed of the cam 35 is not increased from ½ speed, the photosensitive drums 1Y, 1M, 1C, and 1K and the development rollers 3Y, 3M, 3C, and 3K are separated at timing 513, 523, 533, and 543 at the first, the second, the third, and the fourth stations, respectively. By increasing the drive speed of the cam 35, the contact time of the photosensitive drum 1 and the development roller 3 can be reduced by a length of time corresponding to the difference between timing 513 and 514 for the first station, timing 523 and 524 for the second station, timing 533 and 534 for the third station, and timing 543 and 544 for the fourth station.

Further, although in the present exemplary embodiment, the time until the image forming by the fourth station is finished is time A and the time until the development roller of the fourth station is separated is time B, the time is not necessarily taken from the fourth station. For example, if the third station takes longer time in image forming compared to the fourth station, the time until the image forming by the third station is finished can be time A and the time until the separation of the development roller of the third station can be time B. In this way, the operation of the cam can be appropriately controlled. In other words, by determining the station which takes the longest time in image forming, the target station to be controlled can be determined and the operation of the cam can be controlled.

Further, according to the description above, although the size of the image formed at each station is compared in determining the target station to be controlled, for example, if the contact time of the fourth station is set to be longer than the contact time of other stations to realize a full-color print and a monocolor print, since it is known that the fourth station is the last station that performs the image forming regardless of the image size, the timing to increase the drive speed can be determined with reference to only the size of the image formed by the fourth station without comparing the size of the images formed at other stations.

Figure 7:
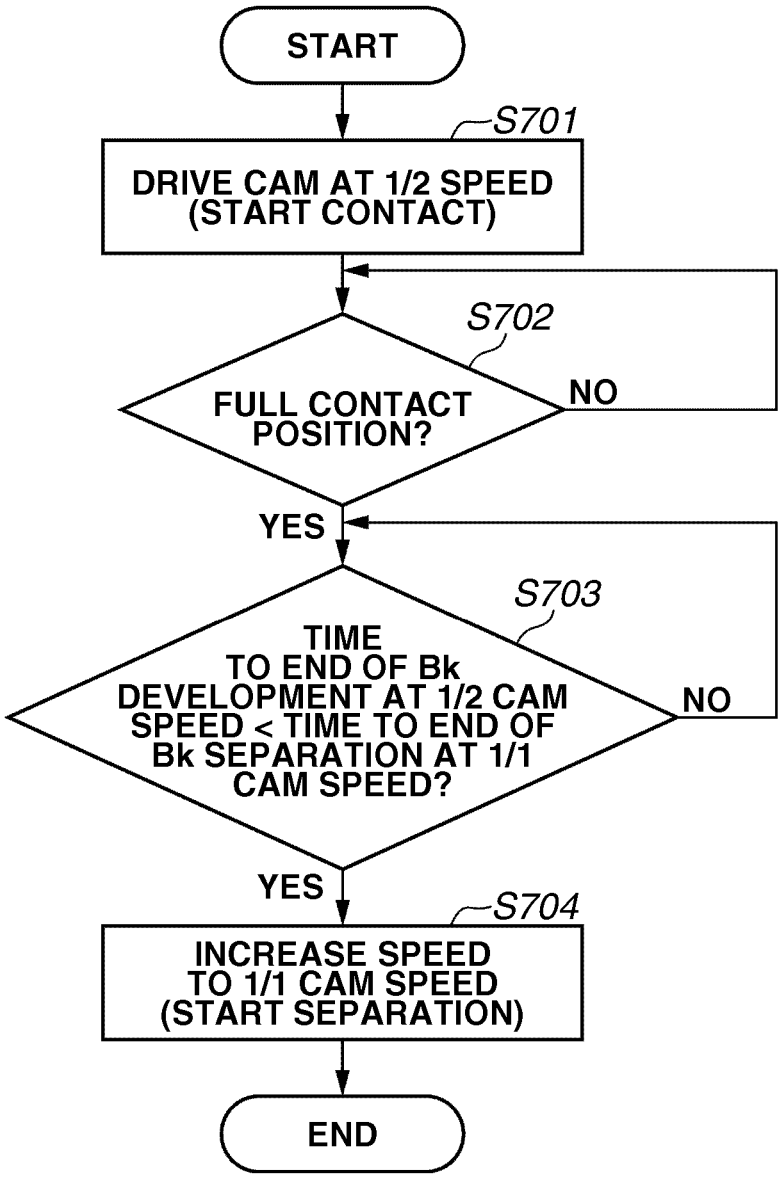
FIG. 7 is a flowchart illustrating control used for increasing a speed of a cam according to the first exemplary embodiment of the present invention.

FIG. 7 is a flowchart illustrating the speed-up control of the cam 35. In step S701, the CPU 26 drives the cam 35 at ½ speed. In step S702, the CPU 26 determines whether the photosensitive drum 1 and the development roller 3 of each station are in the full contact position in the contact state.

If the photosensitive drum 1 and the development roller 3 are in the full contact position (YES in step S702), the processing proceeds to step S703. In step S703, the CPU 26 compares a time A from when the photosensitive drums and the development rollers are set in the full contact position to when the image forming of the fourth station is completed, and a time B from when the photosensitive drums and the development rollers are set in the full contact position to when the development roller of the fourth station is separated according to the drive of the cam 35 at 1/1 speed. If time A≧time B (NO in step S703), the drive speed of the cam 35 is unchanged and the speed remains at ½ speed. If time A<time B (YES in step S703), then the processing proceeds to step S704. In step S704, the CPU 26 increases the drive speed of the cam 35 to 1/1 speed and performs the separation operation of each station.

Although in the present exemplary embodiment, the timing to increase the speed is controlled based on the time that is necessary in the image forming, the timing can also be controlled, even if the time required in the image forming is not fixed, based on, for example, paper size. When it is assumed that an image is formed in the whole area of the paper, if occurrence of contact time that is not used for image forming is recognized, the timing to increase the drive speed can also be controlled by the time required for image forming.

As described above, if the image forming time is shorter than the contact time of the photosensitive drum 1 and the development roller 3, the abrasion of the photosensitive drum 1 and the development roller 3 can be reduced by increasing the drive speed of the cam 35.

According to the first exemplary embodiment, the drive speed of the cam 35 is increased from ½ speed to 1/1 speed. According to a second exemplary embodiment of the present invention, a method for setting a drive speed in a case where the drive speed of the cam 35 is not only increased to 1/1 speed but can be freely changed. In the following description, descriptions of configurations similar to those of the first exemplary embodiment are omitted.

Figure 8:
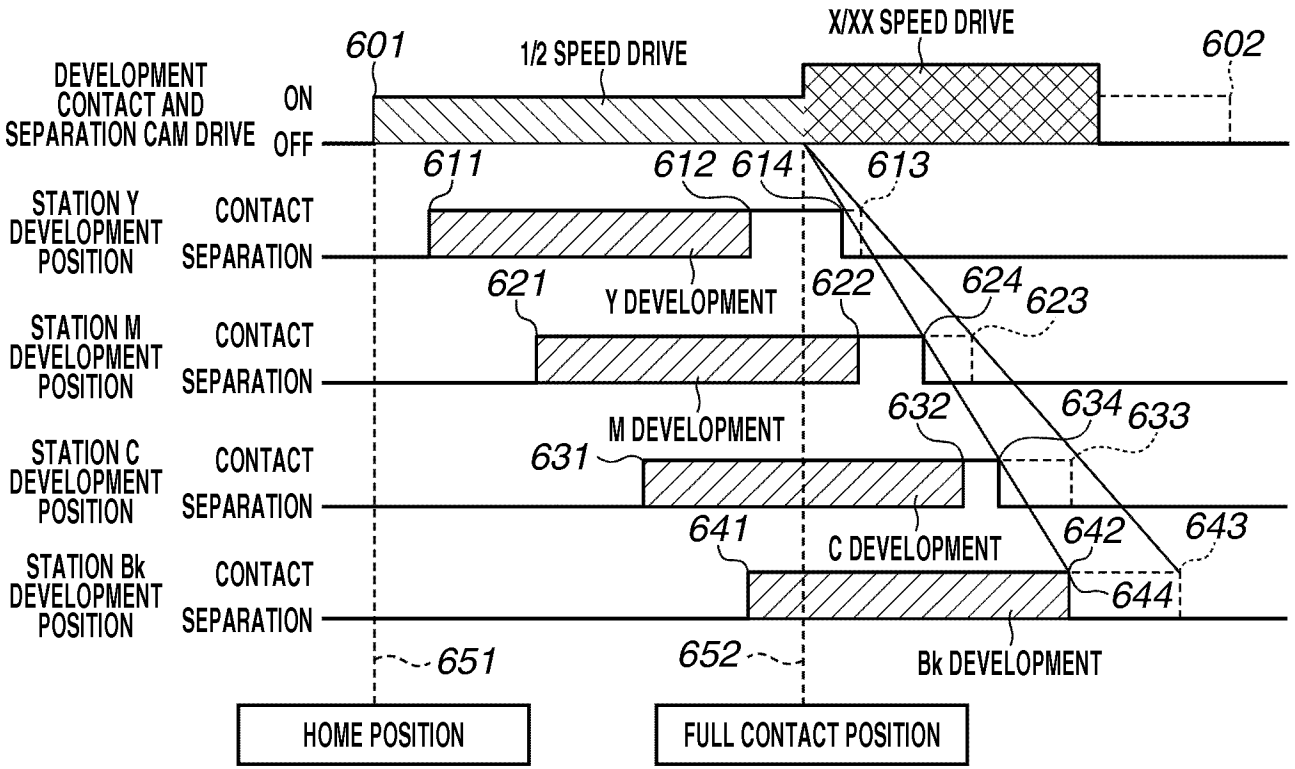
FIG. 8 is a timing chart illustrating the contact and the separation states of each image forming station according to a second exemplary embodiment of the present invention.

FIG. 8 is a timing chart illustrating the contact and the separation states of each of the image forming stations according to the second exemplary embodiment. At timing 601, the CPU 26 drives the cam 35 at ½ speed. At timing 611, the development roller 3Y of the first station contacts the photosensitive drum 1Y and the image forming is started. Further, at timing 621, 631, and 641, the development rollers 3M, 3C, and 3K of the second, the third, and the fourth stations contact the photosensitive drums 1M, 1C, and 1K, respectively, and the image forming is started.

If the photosensitive drums and the development rollers of the image forming stations are set to the full contact position at timing 652, the CPU 26 calculates time C and time D. Time C is the time from the timing of the full contact position to the timing the development roller 3K of the fourth station is separated from the photosensitive drum 1K when the cam 35 is continuously driven at ½ speed. Time D is the time from the timing of the full contact position to the timing the image forming at the fourth station is finished. Then, the drive speed of the cam 35 can be obtained from the following equation (1).

$$\text{drive speed of cam 35} = \text{time } D/\text{time } C * \text{current drive speed of cam 35}(\tfrac{1}{2}\text{ speed}) \quad (1)$$

By increasing the drive speed of the cam 35 from ½ speed to the speed obtained from the above-described equation (1), the development rollers 3Y, 3M, 3C, and 3K are separated from the photosensitive drums 1Y, 1M, 1C, and 1K at timing 614, 624, 634, and 644 at the first, the second, the third, and the fourth stations, respectively. If the drive speed of the cam 35 is not increased from ½ speed, the photosensitive drums 1Y, 1M, 1C, and 1K and the development rollers 3Y, 3M, 3C, and 3K are separated at timing 613, 623, 633, and 643 at the first, the second, the third, and the fourth stations, respectively.

By increasing the drive speed of the cam 35, the contact time of the photosensitive drum 1 and the development roller 3 can be reduced by the length of time between timing 613 and 614 for the first station, time between timing 623 and 624 for the second station, time between timing 633 and 634 for the third station, and time between timing 643 and 644 for the fourth station.

Figure 9:
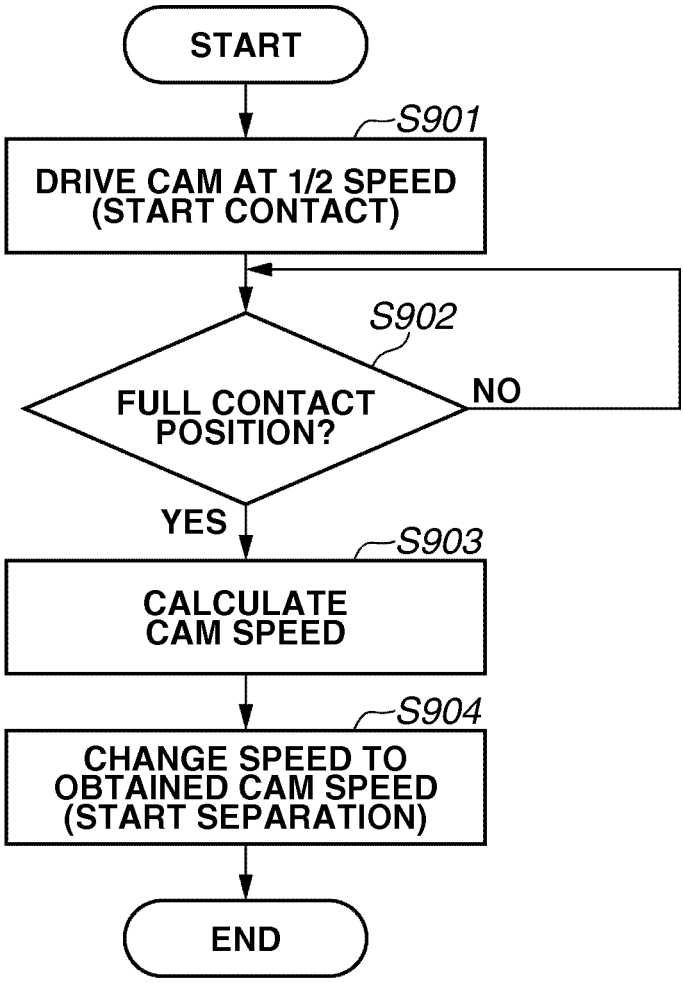
FIG. 9 is a flowchart illustrating control used for increasing a speed of a cam according to the second exemplary embodiment of the present invention.

FIG. 9 is a flowchart illustrating the speed-up control of the cam 35. In step S901, the CPU 26 drives the cam 35 at ½ speed. In step S902, the CPU 26 determines whether the photosensitive drum 1 and the development roller 3 of each station are in the full contact position in the contact state.

If the photosensitive drum 1 and the development roller 3 of each station are set to the full contact position (YES in step S902), the processing proceeds to step S903. In step S903, the CPU 26 calculates time C and time D. Time C is the time from the timing of the full contact position to the timing the development roller 3K of the fourth station is separated from the photosensitive drum 1K when the cam 35 is continuously driven at ½ speed. Time D is the time from the timing of the full contact position to the timing the image forming at the fourth station is finished. Then, the CPU 26 obtains the drive speed of the cam 35 from the above-described equation (1). In step S904, the CPU 26 drives the cam 35 at the drive speed obtained from the equation (1).

As described above, if the image forming time is shorter than the contact time of the photosensitive drum 1 and the development roller 3, the reduction of the operating life of the photosensitive drum 1 and the development roller 3 can be retarded by increasing the drive speed of the cam 35.

According to the first and the second exemplary embodiments, the contact time of each station is reduced by increasing the drive speed of the cam 35. Regarding the methods described in the first and the second exemplary embodiments, longer contact time is reduced for the station that starts the contact at later timing. Thus, the fourth station can reduce the contact time the most and the first station can reduce the contact time the least. According to a third exemplary embodiment, the contact time of the first station is reduced as much as possible. In the following description, descriptions of the configurations similar to those of the first and the second exemplary embodiments are not repeated.

Figure 10:
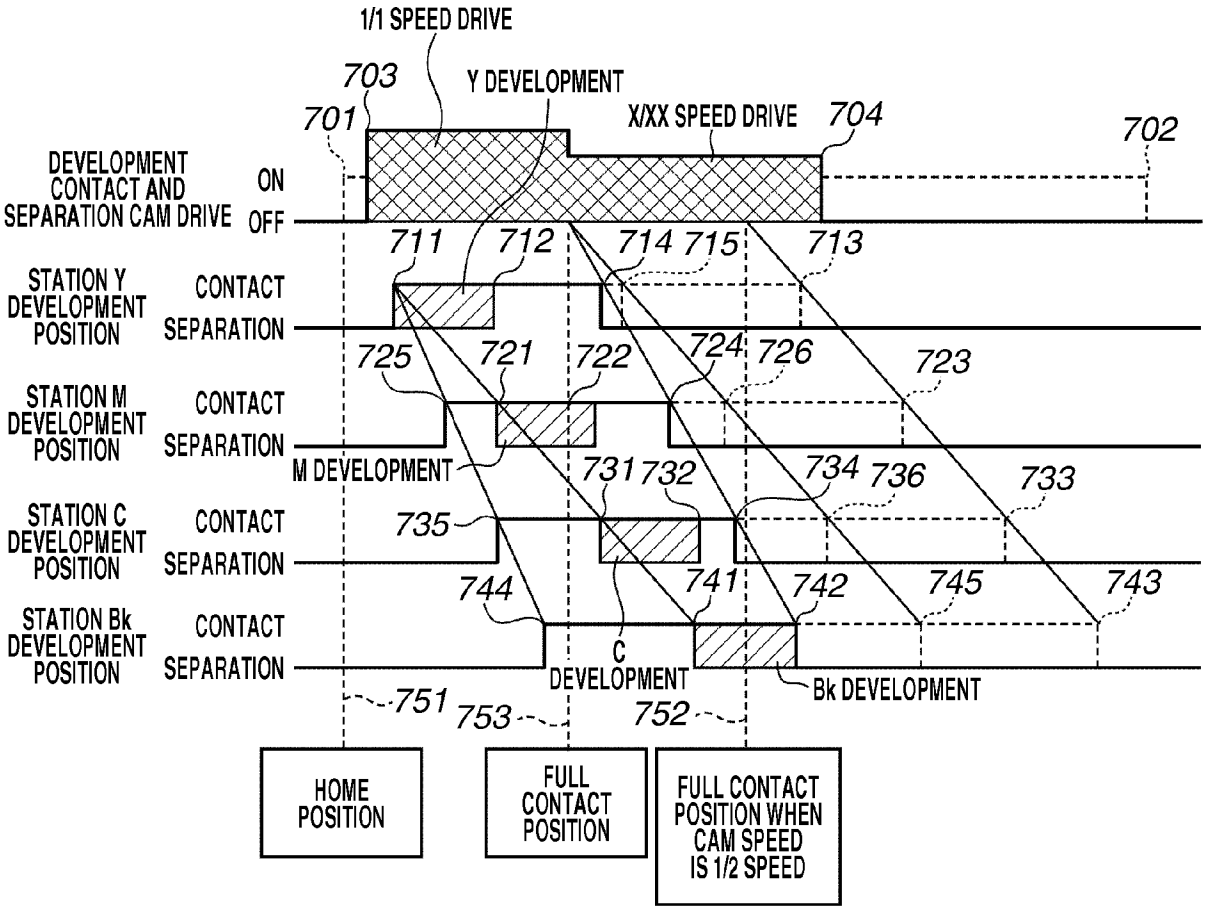
FIG. 10 is a timing chart illustrating the contact and the separation states of each image forming station according to a third exemplary embodiment of the present invention.

FIG. 10 is a timing chart illustrating the contact and the separation states of each of the image forming stations according to the third exemplary embodiment. The present exemplary embodiment is described based on the assumption that the drive speed of the cam 35 is 1/1 speed and the process speed used for the image forming is ½ speed.

At timing 701, the CPU 26 does not start the drive of the cam 35 for the contact development at a drive speed of ½ speed from the home position. At timing 703, the CPU 26 sets the drive speed of the cam 35 to 1/1 speed. At timing 711, the CPU 26 starts the drive of the cam 35 so that the development roller 3Y contacts the photosensitive drum 1Y of the first station. When the development roller 3Y of the first station contacts the photosensitive drum 1Y at timing 711, the image forming is started.

Further, at timing 725, although the development roller 3M of the second station contacts the photosensitive drum 1M, since the process speed is ½ speed, the image forming at the second station is started at timing 721. Further, at timing 735, although the development roller 3C of the third station contacts the photosensitive drum 1C, since the process speed is ½ speed, the image forming at the third station is started at timing 731. Further, at timing 744, although the development roller 3K of the fourth station contacts the photosensitive drum 1K, since the process speed is ½ speed, the image forming at the fourth station is started at timing 741.

As described above, if the drive speed of the cam 35 is increased when the contact for development is performed, the development roller 3 contacts the photosensitive drum 1 before the image forming is started with respect to the second to the fourth stations. Since the contact timing of each station is set at earlier timing, the timing of the full contact position (timing 753) will be earlier than the timing of the full contact position at timing 752 when the cam 35 is driven at ½ speed. The separation performed at the first station can start early by reaching the full contact position early.

If the image forming stations are set to the full contact position at timing 753, the CPU 26 determines whether it is appropriate to keep the drive speed of 1/1 speed for the cam 35. Specifically, the CPU 26 calculates time E and time F. Time E is the time from the timing of the full contact position to the timing the development roller 3K of the fourth station is separated from the photosensitive drum 1K when the cam 35 is continuously driven at 1/1 speed. Time F is the time from the timing of the full contact position to the timing the image forming at the fourth station is finished when the process speed is ½ speed. Then, the drive speed of the cam 35 can be obtained from the following equation (2).

$$\text{drive speed of cam 35} = \text{time } F/\text{time } E^{*}\text{current drive speed of cam 35(1/1 speed)} \quad (2)$$

By changing the drive speed of the cam 35 from 1/1 speed to the speed obtained from the above-described equation (2), the end of the image forming at the fourth station and the timing of separation of the development roller 3K from the photosensitive drum 1K of the fourth station can be matched. In this way, the contact time at the first station can be reduced as much as possible.

Figure 11:
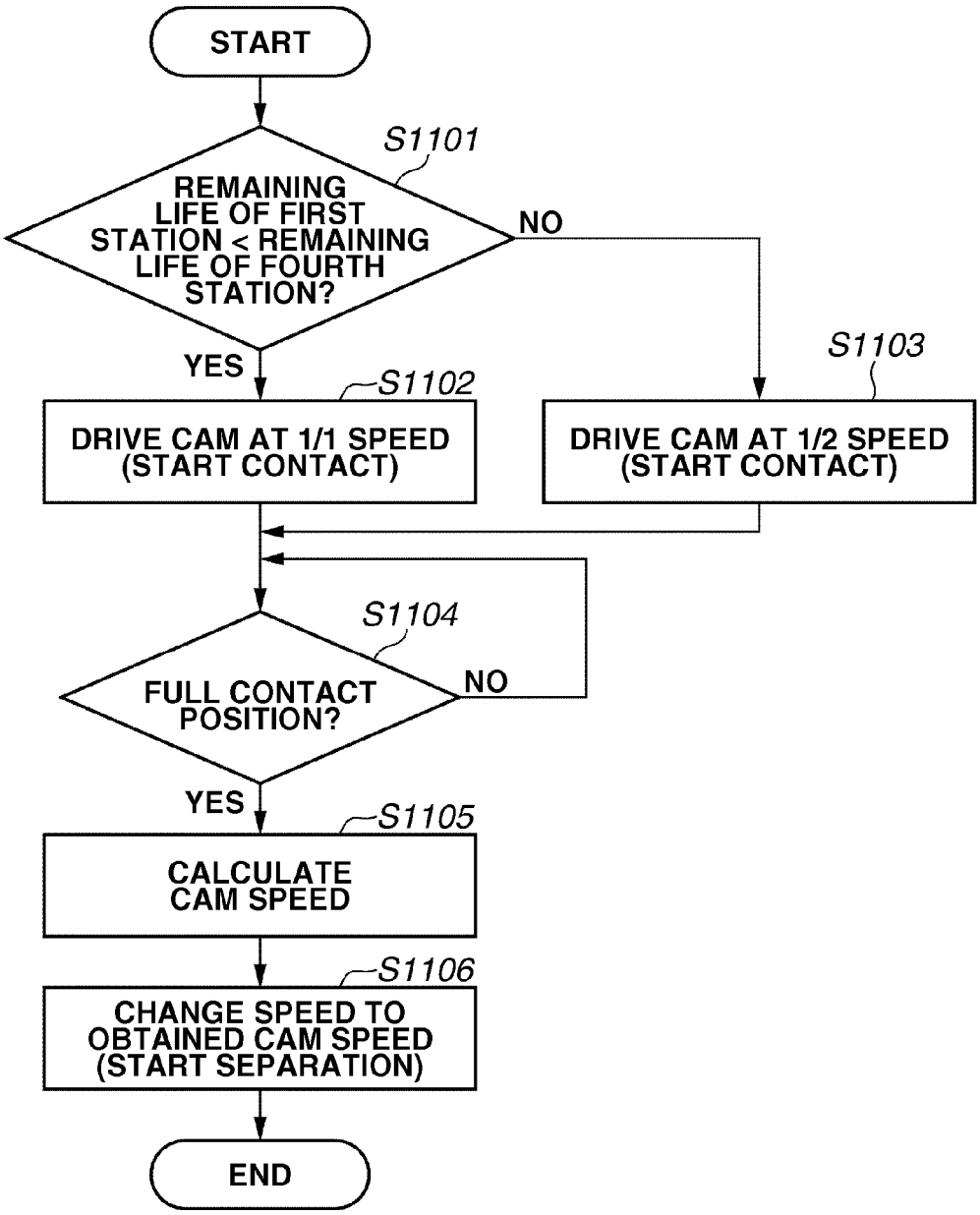
FIG. 11 is a flowchart illustrating control used for increasing a speed of a cam according to the third exemplary embodiment of the present invention.

FIG. 11 is a flowchart illustrating control for reducing the contact time at the first station. In step S1101, the CPU 26 calculates a ratio of the remaining toner level with respect to the remaining life of the development roller 3 or the photosensitive drum 1 of the first station and the fourth station, and determines which life of the stations has priority.

For example, with respect to the first station, if the remaining life of the development roller 3Y is set as A1%, the remaining life of the photosensitive drum 1Y is set as B1%, and the remaining toner level is set as C1%, and further, with respect to the fourth station, if the remaining life of the development roller 3K is set as A4%, the remaining life of the photosensitive drum 1K is set as B4%, and the remaining toner level is set as C4%. The CPU 26 compares the remaining life by calculating a ratio Val 1a, which is a ratio of the remaining life of the development roller 3Y with respect to the remaining toner level according to Val 1a=A1/C1, and calculating a ratio Val 1b, which is a ratio of the remaining life of the photosensitive drum 1Y with respect to the remaining toner level according to Val 1b=B1/C1. Then, the CPU 26 compares Val 1a and Val 1b and sets the smaller value as the remaining life ratio Val 1 of the first station.

Next, the CPU 26 compares the remaining life by calculating a ratio Val 4a, which is a ratio of the remaining life of the development roller 3K with respect to the remaining toner level according to Val 4a=A4/C4, and calculating a ratio Val 4b, which is a ratio of the remaining life of the photosensitive drum 1K with respect to the remaining toner level according to Val 4b=B4/C4. Then, the CPU 26 compares Val 4a and Val 4b and sets the smaller value as the remaining life ratio Val 4 of the fourth station. Although in the present exemplary embodiment, the remaining life of the first station and the remaining life of the fourth station are compared in determining the drive speed of the cam 35, other methods can also be used. For example, the control can be changed by setting a mode that places priority on the reduction of the contact time at the first station or at the fourth station.

In step S1101, the CPU 26 compares Val 1 with Val 4. Then if Val 1 is smaller than Val 4 (YES in step S1101), the processing proceeds to step S1102. In step S1102, the CPU 26 drives the cam 35 at 1/1 speed. If Val 1 is equal to or larger than Val 4 (NO in step S1101), the processing proceeds to step S1103. In step S1103, the CPU 26 drives the cam 35 at ½ speed. If the cam 35 is driven at ½ speed, since the control will be the same as the control described with reference to the flowchart in FIG. 9, its description is not repeated.

In step S1104, the CPU 26 determines whether the photosensitive drum 1 and the development roller 3 of each station are in the contact state. If the stations are in the full contact position (YES in step S1104), the processing proceeds to step S1105. In step S1105, the CPU 26 calculates time E from the timing of the full contact position to the timing the development roller 3K of the fourth station is separated from the photosensitive drum 1K when the cam 35 is continuously driven at 1/1 speed and time F from the timing of the full contact position to the timing the image forming at the fourth station is finished when the process speed is ½ speed, and obtains the drive speed of the cam 35 from the above-described equation (2). In step S1106, the CPU 26 drives the cam 35 at the drive speed obtained from the equation (2).

In this manner, if the image forming time is shorter than the contact time of the photosensitive drum 1 and the development roller 3, by increasing the drive speed of the cam 35 when the development roller 3 contacts the photosensitive drum 1, the reduction of life of the photosensitive drum 1 and the development roller 3 can be retarded.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-159883 filed Jul. 14, 2010, which is hereby incorporated by reference herein in its entirety.

What is claimed is:

1. An image forming apparatus comprising:

a plurality of image carriers;

a plurality of developing units configured to contact each of the plurality of image carriers to develop a latent image formed on each of the plurality of image carriers;

a contact and separation unit configured to perform contact and separation of the plurality of image carriers and the plurality of developing units;

a drive unit configured to drive the contact and separation unit; and a control unit configured to control a drive speed of the drive unit so that the plurality of developing units are separated from the plurality of image carriers after the development performed by the plurality of developing units is completed; and wherein the control unit performs control such that, out of the plurality of image carriers and the plurality of developing units, upon completion of the development performed by a last developing unit whose development of the latent image formed on the image carrier is performed last, by driving the drive unit, which is driving at a predetermined speed, at a drive speed faster than the predetermined drive speed so that the last developing unit is separated after the completion timing of the development performed by the last developing unit and before separation timing of the last developing unit when the drive speed of the drive unit is unchanged and the drive unit is driven at the predetermined speed.

2. The image forming apparatus according to claim 1, wherein the drive unit is composed of one drive source.

3. The image forming apparatus according to claim 1, wherein the control unit delays contact timing of the plurality of image carriers and the plurality of developing units by the drive unit and increases the drive speed when the plurality of image carriers contact the plurality of developing units.

* * * * *